US006126047A

United States Patent [19]

Johnson et al.

[11] Patent Number: 6,126,047

[45] Date of Patent: Oct. 3, 2000

[54] DISPENSING NOZZLE

[75] Inventors: Tab C. Johnson, Ossian; Kraig J. Schlosser, Fort Wayne, both of Ind.

[73] Assignee: Tuthill Corporation, Hinsdale, Ill.

[21] Appl. No.: 09/369,949

[22] Filed: Aug. 6, 1999

Related U.S. Application Data

[60] Provisional application No. 60/095,537, Aug. 6, 1998.

[51] Int. Cl.[7] ..... B67D 3/00; B67D 5/06

[52] U.S. Cl. ..... 222/505; 222/507; 141/206; 141/208; 141/209

[58] Field of Search ..... 141/59, 206, 208, 141/209, 387, 389, 392; 222/505, 507

[56] References Cited

U.S. PATENT DOCUMENTS

| | | | |
|---|---|---|---|
| 408,687 | 8/1889 | Brandly . | |
| 1,990,741 | 9/1935 | Marvel . | |
| 2,227,578 | 1/1941 | Fraser . | |
| 2,528,697 | 11/1950 | Logan et al. . | |
| 2,786,493 | 3/1957 | Pacey . | |
| 2,934,103 | 4/1960 | Frise . | |
| 3,035,615 | 5/1962 | Pacey . | |
| 3,174,518 | 3/1965 | Klaus . | |
| 3,224,472 | 12/1965 | Ehlers | 141/209 |
| 3,285,564 | 11/1966 | Mansfield . | |
| 4,005,339 | 1/1977 | Plantard | 141/392 |
| 4,796,678 | 1/1989 | Motohashi et al. | 141/206 |
| 4,927,115 | 5/1990 | Bahroos et al. . | |
| 5,323,820 | 6/1994 | Brand . | |
| 5,515,889 | 5/1996 | Brand . | |

*Primary Examiner*—Henry J. Recla
*Assistant Examiner*—Timothy L. Maust
*Attorney, Agent, or Firm*—Barnes & Thornburg

[57] ABSTRACT

Fluid dispensing nozzles which include valve mechanisms that allow fluid flow around substantially the entire periphery of valve elements. The valve elements are located in a substantially linear central flow path formed in the bodies of the dispensing nozzles. Dispensing spouts are coupled to the nozzle bodies so that the axes of the dispensing spouts intersect the angle of the axes of the central flow paths at obtuse angles, and preferably at angles which reduce flow resistance. The dispensing nozzles of the present invention include push rod bores and bores for receiving the dispensing spouts which bores are parallel so that they can be machined simultaneously, thereby reducing machining steps and manufacturing costs.

20 Claims, 6 Drawing Sheets

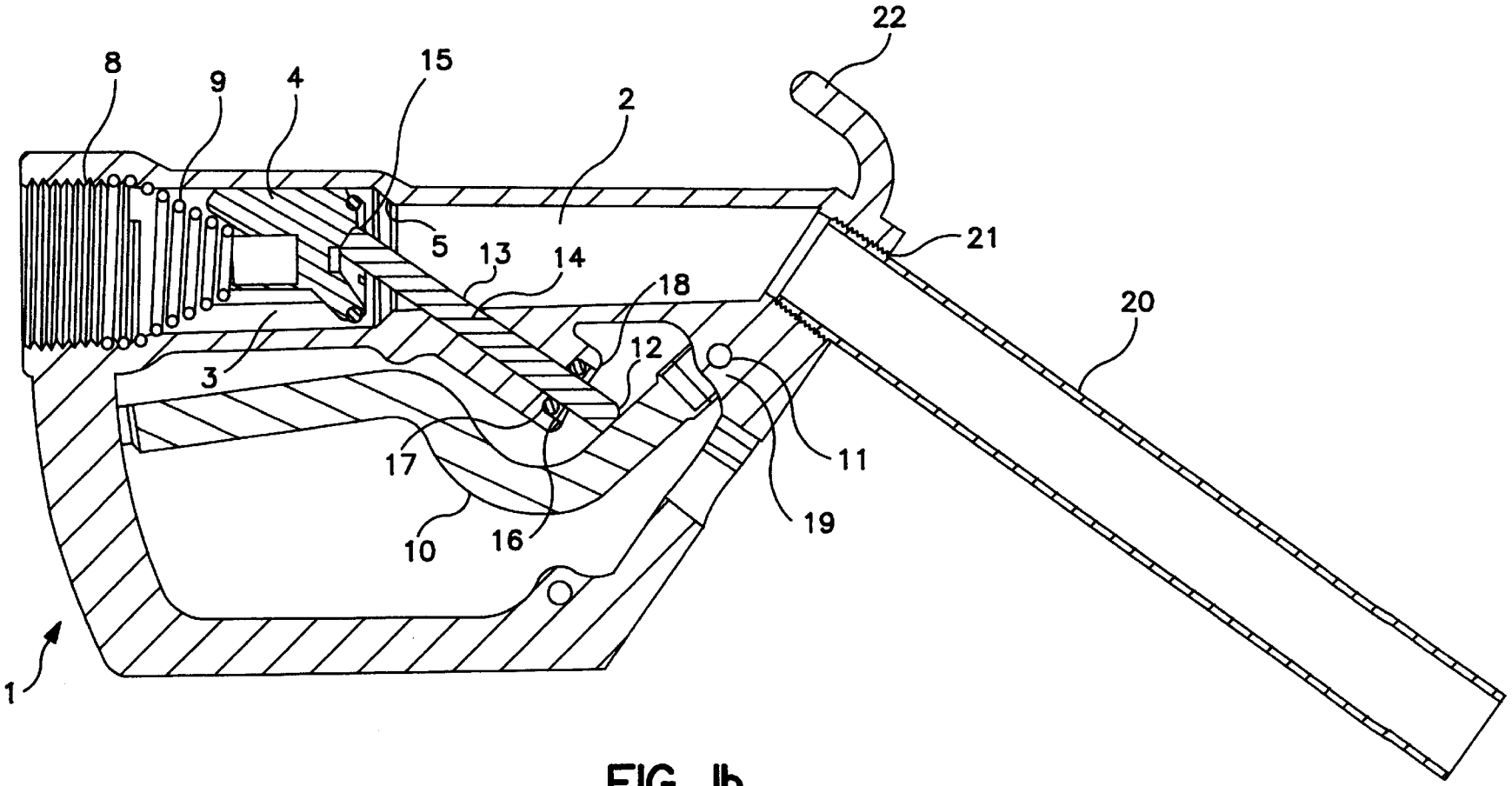
FIG. Ib

DISPENSING NOZZLE

RELATED APPLICATION

The present application is based upon U.S. Provisional Application Ser. No. 60/095,537, filed Aug. 6, 1998, the complete disclosure of which is hereby expressly incorporated by reference.

TECHNICAL FIELD

The present invention relates to fluid dispensing nozzles. More particularly, the present invention relates to fluid dispensing nozzles which have improved flow characteristics and which can be manufactured in cost efficient manners.

BACKGROUND ART

Fluids are often dispensed or transferred from bulk tanks or other primary receptacles to secondary tanks or receptacles using a length of hose having a nozzle attached to one end thereof. The other end of the hose can be attached directly to the bulk tank or primary receptacle or to a pumping system. The nozzle is used to control the flow of fluid though the hose. The nozzle also provides a spout which can be inserted in a tank or secondary receptacle into which fluid is to be dispensed or transferred. The spout thus directs the flow of fluid during dispensing or transfer. Nozzles typically include valve mechanisms which are operated by pivotal hand levers. Pulling or squeezing the hand lever opens and closes the valve mechanism and thus controls the flow of fluid during dispensing or transfer.

The following U.S. patents exemplify various nozzle designs: U.S. Pat. No. 5,515,889 to Brand, U.S. Pat. No. 5,323,820 to Brand, U.S. Pat. No. 3,285,564 to Mansfield, U.S. Pat. No. 3,174,518 to Klaus, U.S. Pat. No. 3,035,615 to Pacey, U.S. Pat. No. 2,934,103 to Frise, U.S. Pat. No. 2,786,493 to Pacey, U.S. Pat. No. 2,528,697 to Logan et al., U.S. Pat. No. 2,227,578 to Fraser, and U.S. Pat. No. 1,990,741 to Marvel. In addition to these patents, U.S. Pat. No. 4,927,115 to Bahroos et al. discloses a hand held spray nozzle, and U.S. Pat. No. 408,687 to Brandly is directed to a faucet.

The present invention is directed to fluid dispensing nozzles which have improved flow characteristics and which can be manufactured in cost efficient manners.

DISCLOSURE OF THE INVENTION

According to other features, characteristics, embodiments and alternatives of the present invention which will become apparent as the description thereof proceeds, the present invention provides a fluid dispensing nozzle which includes:

- a body having a linear fluid passageway, the fluid passage including a valve chamber and an adjacent chamber;
- a valve assembly positioned in the valve chamber and including a valve;
- a push rod extending through a side of the adjacent chamber and contacting the valve; and
- a hand lever pivotally coupled to the body and contacting the push rod so that movement of the hand lever effects opening of the valve.

The present invention also provides a fluid dispensing nozzle which includes:

- a body having:
  - a first linear bore which defines a fluid passageway through the body;
  - a second bore intersecting an end of the first linear bore at an obtuse angle; and
  - a third bore intersecting an intermediate portion of the first linear bore and being parallel to the second bore;
- a dispensing spout coupled to and extending from the second bore;
- a push rod located in and extending through the third bore;
- a valve assembly positioned in the first linear bore and including a valve which is in contact with the push rod; and
- a hand lever pivotally coupled to the body and contacting the push rod so that movement of the hand lever effects opening of the valve.

BRIEF DESCRIPTION OF DRAWINGS

The present invention will be described hereafter with reference to the attached drawings which are given as non-limiting examples only, in which:

FIG. 1*b* is a cross-sectional side view of an alternative embodiment of the dispensing nozzle of FIG. 1*a*.

BEST MODE FOR CARRYING OUT THE INVENTION

The present invention is directed to fluid dispensing nozzles. The dispensing nozzles of the present invention include hollow bodies that have linear flow paths through the nozzle body and flow paths with a single moderate angle near the dispensing spouts of the nozzles. The use of linear or substantially linear flow paths will allow reduced resistance to fluid flow through the dispensing nozzles. The dispensing nozzles of the present invention include valve elements which are coaxial with the linear flow paths. The valve elements open and close (seat) when moved linearly along the direction of fluid flow and are designed to allow fluid to flow substantially around the entire periphery of the valve elements, thereby allowing reduced resistance to fluid flow through the dispensing nozzle.

The dispensing nozzles of the present invention can include parallel bores for receiving a dispensing spout and a push rod which actuates the valve element. The use of parallel bores for the dispensing spout and the push rod, allow for simultaneous machining of the bores and a reduction in manufacturing steps and costs. That is, the bodies of the dispensing nozzles can be cast according to known manufacturing processes and the bores which receive the dispensing spout and push rod can be machined at the same time using parallel boring tools. The linear flow path that extends through the hollow nozzle bodies can also be machined easily in the cast nozzle bodies.

Figure 1A:
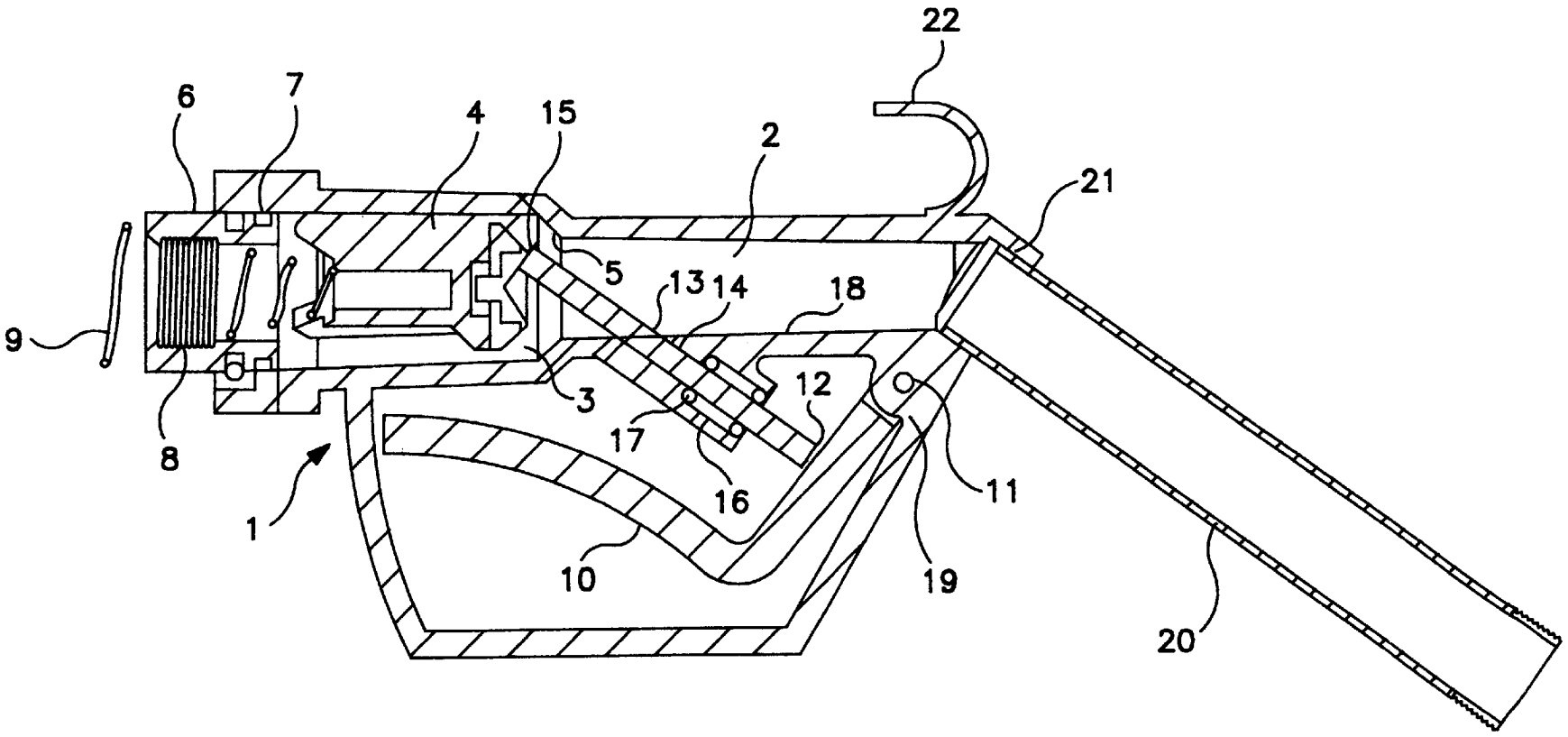
FIG. 1*a* is a cross-sectional side view of a dispensing nozzle according to one embodiment of the present invention.

FIG. 1*a* is a cross-sectional side view of a dispensing nozzle according to one embodiment of the present invention. As depicted, the nozzle body 1 includes a central bore 2 which extends therethrough. The central bore 2 is substantially linear and can include a stepped portion as discussed below. The central bore 2 of the nozzle body 1 includes a valve chamber 3 which houses valve element 4. The valve chamber 3 includes a valve seat 5 at a forward end thereof. The valve seat 5 can be defined by a tapered, stepped or narrowed portion of the central bore 2 as depicted, in which case the diameter of the valve chamber 3 will be larger than the forward portion of the central bore 2. Alternatively, the valve seat 5 could be defined by an annular insert, in which case the central bore 2 could have a uniform diameter throughout its length. An annular retainer or swivel 6 is inserted into the rear of the valve chamber 3 as depicted. The annular retainer or swivel 6 can be press-fit or inserted into the portion of the central bore 2 which defines the valve chamber 3, or coupled therein by mechanical structures such as internal or external threads, pins, etc. A seal or gasket member 7 such as an o-ring can be included to provide a fluid tight seal between the annular retainer or swivel 6 and the portion of the central bore 2 which defines the valve chamber 3.

The annular retainer or swivel 6 includes coupling structure 8 such as internal threads, bayonet connector structure, threaded couplers, or the like by which a hose or hose coupling can be attached to the nozzle body. FIG. 1*a* depicts a spring element 9 which biases the valve element 4 against the valve seat 5, so that the valve is normally closed. This spring element 9 can be held in place by the annular retainer or swivel 6, or a hose or hose coupler, or other coupler which is coupled to the annular retainer or swivel 6. According to one embodiment, the spring element 9 can be held in place by engaging the coupling structure 8 of the annular retainer or swivel 6.

The valve element 4 is actuated by hand lever 10. Pulling or squeezing hand lever 10 causes the hand lever 10 to pivot about fulcrum or pivot point 11. As the hand lever 10 pivots about fulcrum or pivot point 11, it pushes against the free end 12 of push rod 13. Push rod 13 is received in and guided by bore 14 so that the distal end 15 thereof contacts a leading portion of the valve element 4. As the push rod 13 is pushed by hand lever 10 it in turn pushes the valve element 4 rearward or away from the valve seat 5, thereby causing the valve to open. Releasing the hand lever 10 allows the push rod 13 to retract within bore 14 so that valve element 4 can move forward and contact valve seat 5. The bore 14 that receives and guides push rod 13 can include a stepped portion 16 having a larger diameter as depicted. This stepped portion 16 can receive a sealing member 17, e.g. an o-ring, and a retainer 18 or bushing which provides a sealing function. It is also possible to include a spring element in stepped portion 16 of bore 14 which can be coupled to push rod 13 and used to apply a biasing force on push rod 13 which biasing force will cause the push rod 13 to normally retract from bore 14 and push hand lever 10 outward or in the closed position. It is also possible to include a spring element in the rear portion 19 of the nozzle body 1 where the fulcrum point 11 is located, or elsewhere between the hand lever 10 and nozzle body 1 to assist in normally keeping the hand lever 10 in the outward or closed position. Normally, the fluid pressure against valve element 4 provides sufficient force to push the push rod 13 against the hand lever 10 so as to maintain the hand lever 10 in its outward or closed position.

Dispensing spout 20 is received in bore 21 which is provided at the front of nozzle body 1. Bore 21 intersects central bore 2 at an angle which is preferably an obtuse angle. The dispensing spout 20 can be press-fit into bore 21, coupled therein by mechanical means such as threaded structures, welded therein, or coupled thereto by any convenient means.

The central bore 1 and sprout 20 ideally form a fluid flow path that has few obstructions or sharp angles. Moreover, as discussed herein, the valve element 4 is designed to allow fluid to flow substantially around the entire periphery of the valve element 4, thereby avoiding resistance to fluid flow through the dispensing nozzle. Thus, the dispensing nozzle of the present invention can provide low resistance to fluid flow during fluid dispensing and transfer procedures.

Bores 14 and 21 can be parallel to each other so that they can be machined at the same time using parallel boring tools. Such simultaneous machining of the bores for the push rod 13 and dispensing spout 20 can reduce machining steps and manufacturing costs. The linear flow path through the hollow nozzle body 1 provided by the central bore 2 can also be easily machined even when a stepped central bore 2 is used to define the valve seat 5 as depicted in FIG. 1*a*. Thus, the nozzle body 1 can be cast with the central bore 2 and bores 14 and 21 for the push rod 13 and the dispensing spout 20. Thereafter, bore 14 can be reamed to remove draft and finish the bore, and threads can be machined in bore 21. The nozzle body 1 can also be provided with a hook 22 or loop or similar structure by which to hang or secure the dispensing nozzle on a tank, pump or similar support.

FIG. 1*b* is a cross-sectional side view of an alternative embodiment of the dispensing nozzle of FIG. 1. The nozzle in FIG. 1*b* is very similar to that of FIG. 1*a*, but differs in the exclusion of the annular retainer or swivel 6 (see FIG. 1*a*). In addition, the valve element 4 comprises a unitary structure. In this regard, the head of the valve element 4 depicted in FIG. 1*a* is formed separately from the body of the valve element 4 and attached thereto. For simplicity, similar reference numbers have been used to identify common elements in FIGS. 1*a* and 1*b*.

Figure 2:
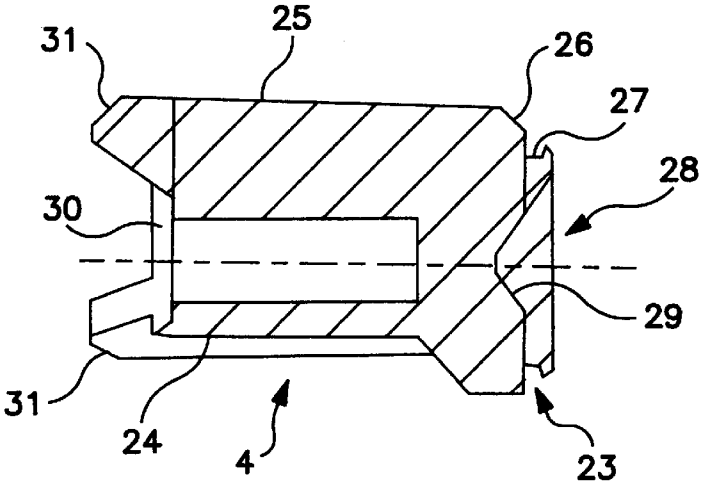
FIG. 2 is a cross-sectional view of a valve element according to one embodiment of the present invention.

FIG. 2 is a cross-sectional view of a valve element according to one embodiment of the present invention. The valve element 4 includes valve head 23 a central portion 24 that extends from the valve head 23 and a plurality of positioning or alignment fins 25 which extend radially outward from the central portion 24 of the valve element 4.

The valve head 23 is configured to seal against valve seat 5 when the valve element 4 is in its forward or closed position. In this regard, the valve head 23 has a circular cross-section and a tapered leading edge 26, and can include a peripheral groove 27 in which to receive a seal member, such as an o-ring.

The face 28 of the valve head 23 includes an indentation 29 which has a conical shape. The angle of indentation 29 is selected so that it is substantially perpendicular to the angle at which the push rod 13 is aligned by bore 24, when the valve element 4 is within valve chamber 3. This alignment insures that the distal end 15 of push rod 13 pushes against the face 28 of valve element 4 when the hand lever 10 is squeezed or pulled. As the valve element 4 is pushed open or rearward by the push rod 13, the distal end 15 of the push rod 13 will slide outwardly along the surface of the indentation 29. It is possible in an alternative embodiment to provide the push rod 13 with a distal end 15 that is curved or spherical, in which case, the angle of the indentation can be varied. For example, a steeper angle (deeper indentation) would cause the valve to open faster and a less steep angle (shallower indentation) would cause the valve to open slower. In the case of making the valve element 4 from a plastic material such as glass filled polyester, less wear on the valve element 4 may occur if the face of the distal end 15 of the push rod 13 is substantially flat.

The central portion 24 of the valve element 4 can be cylindrical as depicted. The central portion 24 of the valve element 4 can further be hollow as depicted in order to reduce its weight. The central portion 24 of the valve element 4 includes an inward tapered end 30 that is opposite the valve head 23. This tapered end 30 can receive the spring element 9 discussed above. In an alternative embodiment, a stepped bore or recess can be included in place of tapered end 30.

The positioning or aligning fins 25 extend radially outward from the central portion 24 of the valve element 4 to a diameter which is slightly smaller than the inside diameter of the valve chamber 3. The outer surfaces of the positioning or aligning fins 25 contact the inner surface of the valve chamber 3 and thereby maintain the position or alignment of the valve element 4 with the valve seat 5, while allowing the valve element 4 to move linearly within the valve chamber 3. Three or more positioning or aligning fins 25 can be used to maintain the position and alignment of the valve element 4. The positioning or alignment fins 25 can be continuous along the axial direction of the valve element 4 as depicted or they can comprise discrete segments. The ends of the positioning or aligning fins 25 which are opposite the valve head 23 can be inwardly tapered in the same manner as the adjacent end 30 of the central portion 24 so as to receive or guide the spring member 9 into the corresponding tapered end 30 of the central portion 24 of the valve element 4. The positioning or aligning fins 25 can also have reversed tapered or chamfered tips 31 which ensure that the valve element 4 slides freely within the valve chamber 3.

Figure 3:
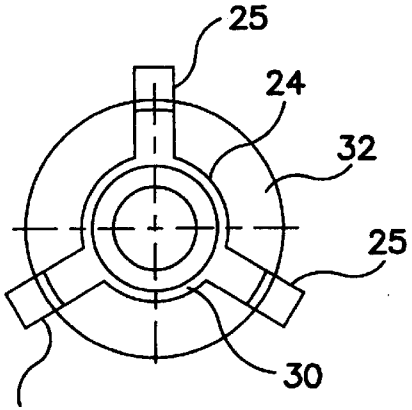
FIG. 3 is an end view of the valve element of FIG. 2.

FIG. 3 is an end view of the valve element of FIG. 2. FIG. 3 depicts how the positioning or alignment fins 25 are equally spaced about the central portion 24 of the valve element 4.

Figure 5:
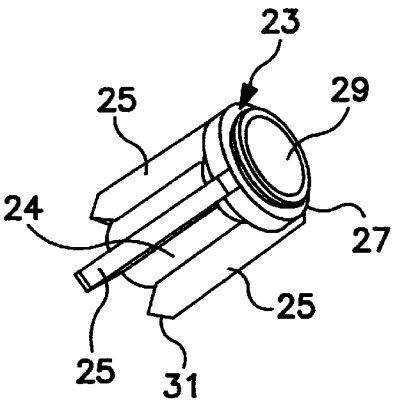
FIG. 5 is another perspective view of the valve element of FIG. 2.
Figure 4:
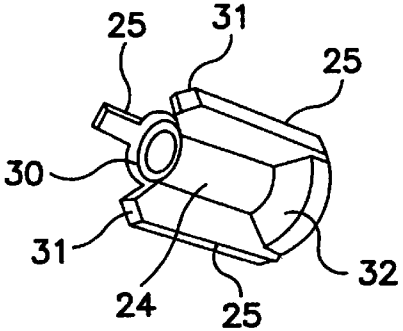
FIG. 4 is a perspective view of the valve element of FIG. 2.

FIG. 4 is a perspective view of the valve element of FIG. 2. FIG. 5 is another perspective view of the valve element of FIG. 2. FIGS. 4 and 5 show that the valve head 23 includes a cylindrical portion and a tapered rear portion 32. This tapered rear portion 32 helps direct fluid flow around the valve head 23 once the valve element 4 is opened.

In an alternative embodiment of the present invention, the positioning or alignment fins 25 could be provided in the valve chamber 3 so that they extend radially inward from the inner surface of the central bore 2. In such an embodiment the valve element 4 would include the valve head 23 and central portion 24.

Figure 6:
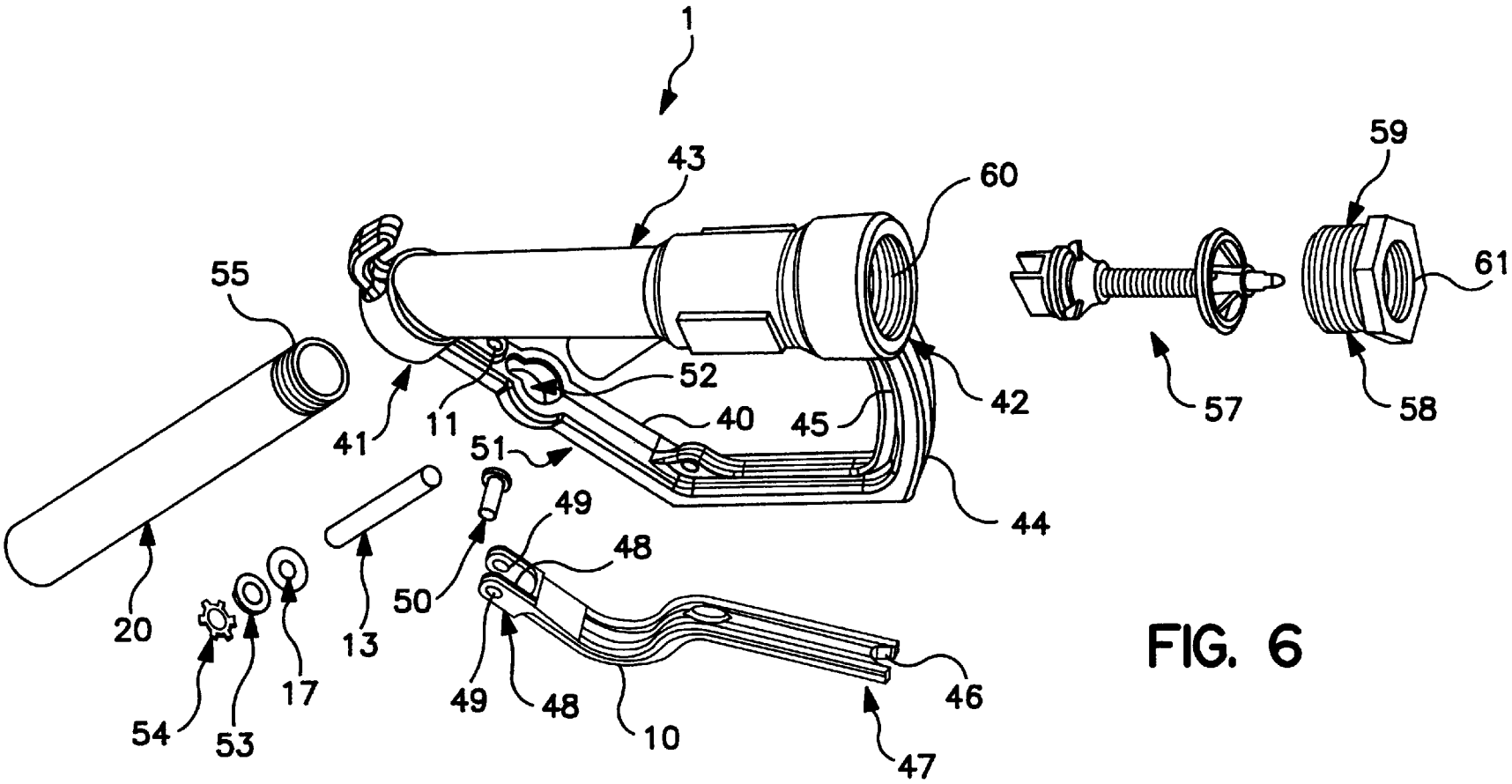
FIG. 6 is an exploded perspective view of a dispensing nozzle according to another embodiment of the present invention.
Figure 7:
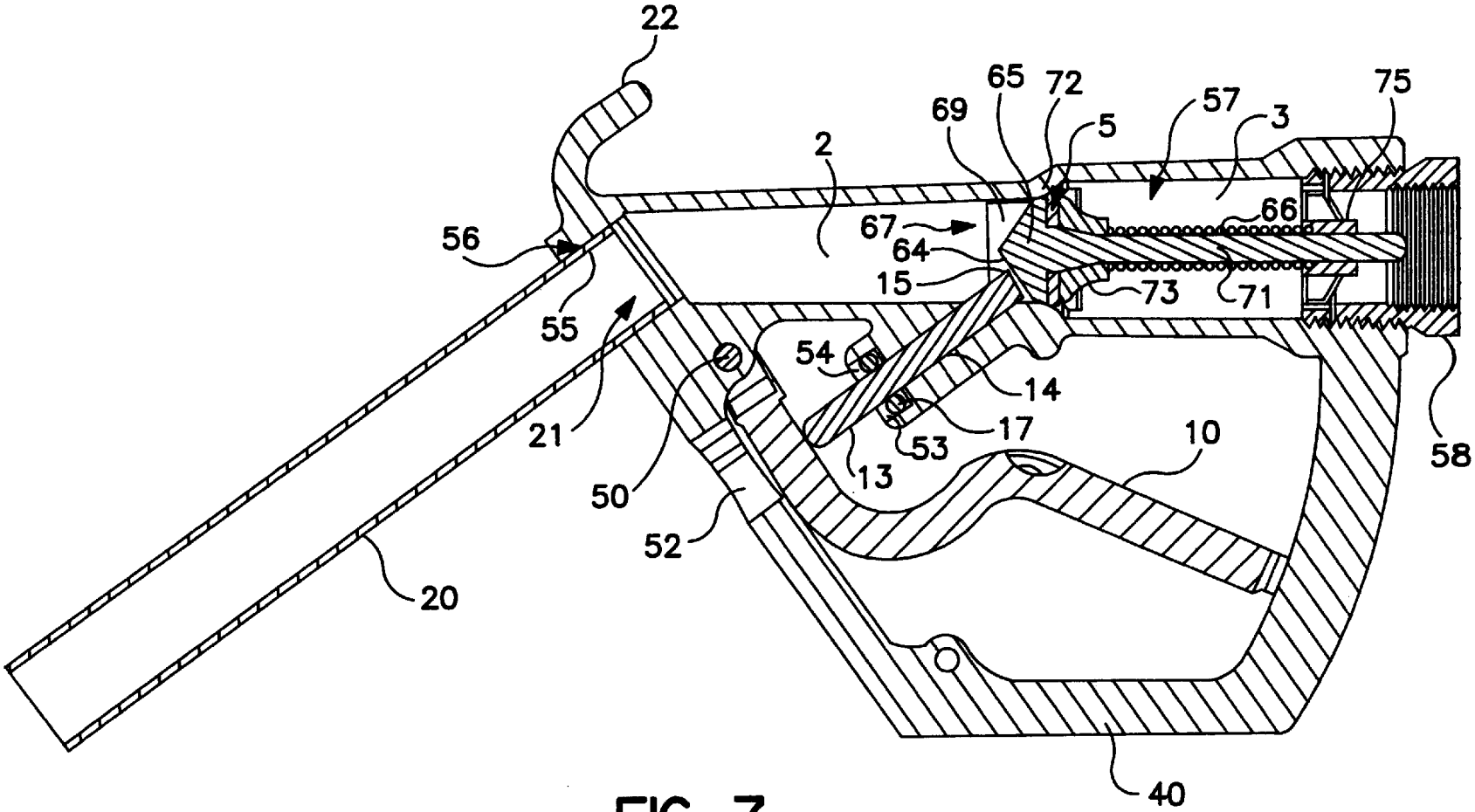
FIG. 7 is a cross-sectional side view of the dispensing nozzle of FIG. 6.

FIG. 6 is an exploded perspective view of a dispensing nozzle according to another embodiment of the present invention. Where possible, common reference numerals are used to identify elements which are common throughout the drawings. The dispensing nozzle depicted in FIG. 1 includes a nozzle body 1 which is formed with an integral lever guard 40 that shields and protects the hand lever 10. The lever guard 40 extends continuously between front 41 and rear 42 ends of a main body portion 43 of the nozzle body 1 which includes central bore 2. (FIG. 7.) The rear portion 44 of the lever guard 40 can include a guide structure 45 which cooperates with a correspondingly shaped guide structure 46 provided on the free end 47 of the hand lever 10. FIG. 6 depicts guide structure 45 as being a raised ridge or track. It is to be understood that other guide structures, including for example, channels, slots, etc., can be used together with hand levers having correspondingly shaped free ends. The pivotal end of hand lever 10 is depicted as having a pair of parallel, spaced apart ears or wings 48 which form a yoke structure. The ears or wings 48 include aligned holes 49 which are provided to receive a pivot pin 50 which can be used to couple the hand lever 10 to fulcrum or pivot point 11. It is noted that the hand lever 10 and/or lever guard 40 can have a ribbed structure as depicted to increase the strength thereof.

The front portion 51 of the lever guard 40 can include an opening 52 that can make assembly of the dispensing nozzle easier. The use of opening 52 which is positioned to be aligned with bore 14 (FIG. 7) will allow the push rod 13 to be inserted into bore 14.

The push rod 13 is depicted as being aligned with opening 52 and bore 14. Also, sealing member 17, washer 53 and retainer 54 are depicted as being aligned with push rod 13 in the order in which they are inserted into bore 14 during assembly.

Dispensing spout 20 is depicted as being aligned with bore 21 at the front of nozzle body 1 and as including an external threaded end portion 55 which can be coupled to corresponding internal threads 56 (FIG. 7) provided in bore 21.

The embodiment of the dispensing nozzle depicted in FIG. 6 includes a valve assembly 57 which is retained in valve chamber 3 by an annual retainer 58 which can have a threaded portion 59 which cooperates with a corresponding threaded portion 60 of bore 1. The annular retainer 58 can, in turn, have a threaded bore 61 by which various coupling elements, hoses, conduits, etc., can be attached to the dispensing nozzle. In alternative embodiments, the annular retainer 58 can be a swivel element and can have a bayonet coupling structure, quick disconnect coupling structure, etc., by which a hose, conduit, or other fluid transfer means can be coupled thereto.

FIG. 7 is a cross-sectional side view of the dispensing nozzle of FIG. 6. FIG. 7 shows the dispensing spout 20 coupled to the nozzle body 1 by their respective cooperating threaded portions 55 and 56. A fluid-tight connection can be ensured by applying a sealing compound at the cooperating threaded portions 55 and 56. It is also possible to provide a seat and a sealing member such as an O-ring at the bottom of bore 21.

FIG. 7 depicts push rod 13 in bore 14, extending between hand lever 10 and a cam surface 64 of valve 65. The push rod 13 is held between hand lever 10 and valve 65 and is sealed in bore 14 by sealing member 17 (e.g O-ring) which is held in place by washer 53 and retainer 54. The push rod 13 can move axially within bore 14 and is biased against hand lever 10 by the force of spring element 66 of valve assembly 57.

The nozzle body 1 includes a central bore 2 which extends therethrough. The central bore 2 is substantially linear and can include a stepped portion. The central bore 2 of the nozzle body 1 includes a valve chamber 3 which houses valve assembly 57. The valve chamber 3 has a valve seat 5 formed on a forward end. The valve seat 5 can be defined by a tapered stepped or narrowed portion of the central bore 2 as depicted, in which case the diameter of the valve chamber 3 will be larger than the forward portion of the central bore 2. Alternatively, the valve seat 5 could be defined by an annular insert, in which case the central bore 2 could have a uniform diameter throughout its length. Valve assembly 57 is retained in valve chamber 3 by annular retainer 58. The nozzle body 1 can also be provided with a hook 22 or loop or similar structure by which to hang or secure the dispensing nozzle on a tank, pump or similar support.

The face 67 of the valve head 68 includes a cam surface 64 and two parallel retaining walls 69 on either side of the cam surface 64. The angle of cam surface 64 is selected so that it is substantially perpendicular to the angle at which the push rod 13 is aligned by bore 14, when the valve assembly 57 is within valve chamber 3. This alignment insures that the distal end 15 of push rod 13 pushes against the face 67 of valve 65 wen the hand lever 10 is squeezed or pulled. As the valve assembly 57 is pushed open or rearward by the push rod 13, the distal end 15 of the push rod 13 will slide outwardly along cam surface 64. It is possible in an alternative embodiment to provide the push rod 13 with a distal end 15 that is curved or spherical, in which case, the angle of the cam surface 64 can be varied. For example, a steeper angle would cause the valve to open faster and a less steep angle would cause the valve 65 to open slower. In the case of making the valve 65 on the head thereof from a plastic material such as glass filled polyester, less wear on the cam surface 64 may occur if the face of the distal end 15 of the push rod 13 is substantially flat and parallel to the cam surface 64. As depicted in the various figures, the valve 65 can include two cam surfaces 64 although only one is used.

Figure 8:
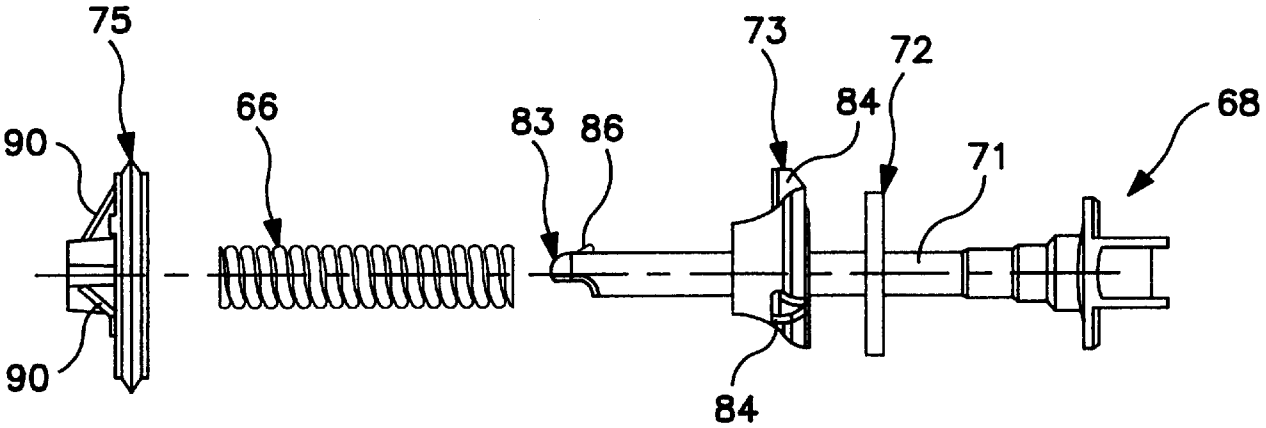
FIG. 8 is an exploded view of the valve assembly of FIG. 6.

FIG. 8 is an exploded view of the valve assembly of FIG. 6. The valve assembly 57 includes a main body having valve head 68 and stem 71, an annular sealing element 72, a guide member 73, a spring 66, and a guide retainer 75.

Figure 9:
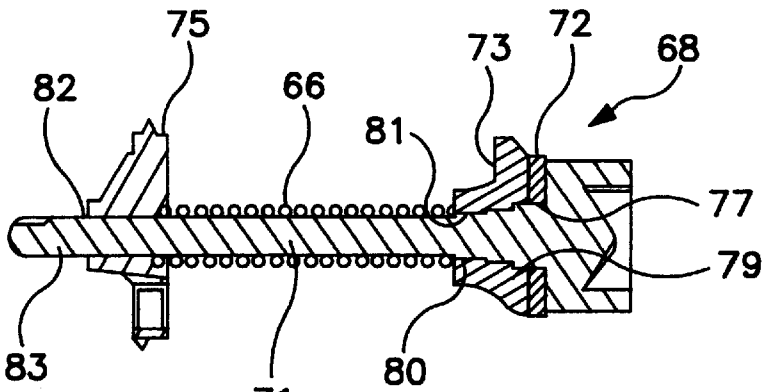
FIG. 9 is a cross-sectional side view of the valve assembly of FIG. 8.

FIG. 9 is a cross-sectional side view of the valve assembly of FIG. 8. The valve stem 71 has a multi-stepped portion adjacent the valve head 68 (see FIG. 8). As seen in FIG. 9, annular sealing element 72 has a central hole with diameter that is approximately the same or slightly smaller than the diameter of the lower stepped portion 77 of the valve stem 71. The guide member 73 includes an internally stepped central hole that includes a lower portion 79 having a diameter which is slightly smaller than the lower stepped portion 77 of the valve stem 71, whereby the guide member 73 can be ultrasonically welded to the lower stepped portion 77 of the valve stem 71. The upper internally stepped portion 80 of the central hole of the guide member 73 has a diameter which is approximately equal to the diameter of upper stepped portion 81 of valve stem 71 so as to axially center the guide member 73 and valve stem 71.

Spring 66 is retained between guide member 73 and guide retainer 75. Guide retainer 75 includes a central hole 82 through which the free end 83 of valve stem 71 may pass. As depicted in FIG. 7, guide member 73 and guide retainer 75 help align valve stem 71 along the central axis of the valve chamber 3 so that annular sealing element 72 can form a sealing contact with the valve seat 5. The guide member 73 includes a plurality of positioning or alignment fins 84 (FIG. 8) that can be symmetrically positioned about the periphery thereof so as to contact the inner surface of valve chamber 3 and align guide member 73 with the central axis of valve chamber 3. The annular spaces between the positioning or alignment fins 84 provide for fluid flow when the valve 65 is open. The guide retainer 75 includes an open annular portion 85 (FIG. 10) through which fluids can pass.

In order to secure spring 66 to the valve assembly 57 the free end 83 of valve stem 71 can include a radial projection 86 (FIG. 8) which is keyed to be received in a correspondingly shaped radial notch 87 (FIG. 10) formed in the guide retainer 75. In order to secure spring 66 to the valve assembly 57 after the guide member 73 is ultrasonically welded onto the valve stem 71, spring 66 is positioned over valve stem 71. Next, the radial notch 87 on the guide retainer 75 is aligned with the radial projection 86 of the valve stem 71 so that the guide retainer 75 is slid on the valve stem 71 and past the radial projection 86. The guide retainer 75 is then rotated so that radial notch 87 and radial projection 86 are out of alignment. The spring 66 then presses the guide retainer 75 against the radial projection 86.

Figure 10:
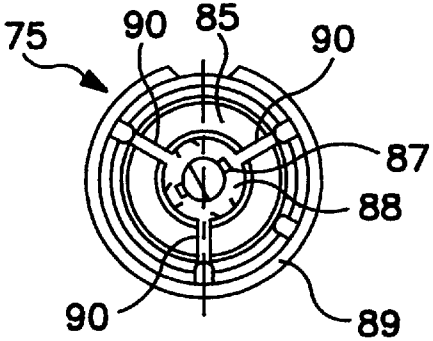
FIG. 10 is an end view of the guide retainer of FIG. 8.

FIG. 10 is an end view of the guide retainer of FIG. 8. The guide retainer 75 includes a central portion 88 and an outer annular portion 89 which are connected together by symmetrically spaced apart radial ribs or webs 90. The radial notch 87 which receives the radial projection 86 on the free end 83 of valve stem 71 is seen in FIG. 10.

As shown in FIG. 7, the leading peripheral edge of the annular sealing element 72 contacts the tapered valve seat 5. As the annular sealing element 72 wears during use, it has been determined that the peripheral edge thereof maintains sealing contact with the tapered valve seat 5.

The structure of the dispensing nozzle of the present invention, including the alignment of the push rod 13 and valve assembly 57, and the manner in which the valve assembly 57 includes spring 66 which biases the valve 65, eliminates the use of caps that are typically used to seal access ports used to assemble dispensing nozzles. Such caps are required by Underwriters Laboratories to include tamper evident seals for safety purposes. The elimination of non-essential access ports reduces the risk of leaky caps and the possibility of nozzles being tampered with.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described in the attached claims.

What is claimed is:

1. A fluid dispensing nozzle which comprises:

a body having a linear fluid passageway, the linear fluid passageway including a valve chamber and an adjacent chamber;

a dispensing spout coupled to a forward end of the linear fluid passageway;

a valve assembly positioned in the valve chamber and including a valve;

a push rod extending through a side of the adjacent chamber and contacting the valve;

a hand lever pivotally coupled to the body and contacting the push rod so that movement of the hand lever effects opening of the valve, the dispensing spout having a central axis that is parallel to a central axis of the push rod and said central axis of said push rod being disposed at an acute angle with respect to a central axis of said linear fluid passageway.

2. A fluid dispensing nozzle according to claim 1, wherein the valve assembly is coaxial with the fluid passageway.

3. A fluid dispensing nozzle according to claim 2, wherein the valve assembly includes axially spaced apart guide elements which maintain its coaxial alignment with the fluid passageway.

4. A fluid dispensing nozzle according to claim 1, wherein the linear fluid passageway is defined by a bore provided in the body and extends substantially across a length of the body.

5. A fluid dispensing nozzle according to claim 1, wherein the axis of the dispensing spout forms an obtuse angle with an axis of the linear fluid passageway.

6. A fluid dispensing nozzle according to claim 1, wherein the valve includes a cam surface and an end of the push rod is in contact with the cam surface.

7. A fluid dispensing nozzle according to claim 1, wherein the valve chamber and the adjacent chamber are separated by a valve seat.

8. A fluid dispensing nozzle according to claim 7, wherein the valve chamber has a diameter which is larger than a diameter of the adjacent chamber.

9. A fluid dispensing nozzle according to claim 1, wherein the valve includes:

a valve head; and a valve stem extending from the valve head, and the valve assembly further includes:

a guide member;

an annular sealing member between the valve head and the guide member;

a spring positioned on the valve stem; and a guide retainer on a free end of the valve stem.

10. A fluid dispensing nozzle comprising:

a body having:

a first linear bore which defines a fluid passageway through the body;

a second bore intersecting an end of the first linear bore at an obtuse angle; and a third bore intersecting an intermediate portion of the first linear bore and being parallel to the second bore;

a dispensing spout coupled to and extending from the second bore;

a push rod located in and extending through the third bore;

a valve assembly positioned in the first linear bore and including a valve which is in contact with the push rod; and a hand lever pivotally coupled to the body and contacting the push rod so that movement of the hand lever effects opening of the valve.

11. A fluid dispensing nozzle according to claim 10, wherein the first linear bore includes a valve seat and the valve is positioned to contact the valve seat when the push rod releases the valve.

12. A fluid dispensing nozzle according to claim 11, wherein the valve assembly includes a spring which biases the valve against the valve seat.

13. A fluid dispensing nozzle according to claim 12, wherein the valve assembly further includes guide elements which maintain axial alignment of the valve.

14. A fluid dispensing nozzle according to claim 13, wherein the guide elements provide for annular flow of fluid through the first linear bore when the valve is open.

15. A fluid dispensing nozzle according to claim 10, wherein a valve seat divides the first linear bore into a valve chamber in which the valve assembly is positioned and an adjacent chamber which is intersected by the second bore and into which the push rod extends to contact the valve.

16. A fluid dispensing nozzle according to claim 15, wherein the valve chamber has a diameter which is larger than a diameter of the adjacent chamber.

17. A fluid dispensing nozzle according to claim 10, wherein the valve includes a cam surface and an end of the push rod is in contact with the cam surface.

18. A fluid dispensing nozzle according to claim 10, wherein the valve includes:

a valve head; and a valve stem extending from the valve head, and the valve assembly further includes:

a guide member;

an annular sealing member between the valve head and the guide member;

a spring positioned on the valve stem; and a guide retainer on a free end of the valve stem.

19. A fluid dispensing nozzle which comprises:

a body having a linear fluid passageway wherein fluid flows from a rearward end to a forward end, the linear fluid passageway including a valve chamber and an adjacent chamber;

a valve assembly positioned in the valve chamber and including a valve having a central axis parallel to the linear fluid passageway;

a spring element which biases the valve assembly towards a forward end of the linear fluid passageway;

a push rod extending through a side of the adjacent chamber and contacting the valve; said push rod having a central axis disposed at an acute angle with respect to a central axis of said linear fluid passageway; and a hand lever pivotally couple to the body and contacting the push rod so that movement of the hand lever effects opening of the valve.

20. A fluid dispensing nozzle which comprises:

a body having a linear fluid passageway, the linear fluid passageway including a valve chamber and an adjacent chamber;

a valve assembly positioned in the valve chamber and including a valve having a central axis parallel to the linear fluid passageway;

a push rod extending through a side of the adjacent chamber and contacting the valve; said push rod having a central axis disposed at an acute angle with respect to a central axis of said linear fluid passageway; and a hand lever pivotally coupled to the body and contacting the push rod so that pivotal movement of the hand lever effects linear movement of the push rod and opening of the valve.

* * * * *